US011445835B2

(12) United States Patent
Carron

(10) Patent No.: US 11,445,835 B2
(45) Date of Patent: Sep. 20, 2022

(54) BABY EXERCISER

(71) Applicant: Gregory Benjamin Carron, Hamilton (CA)

(72) Inventor: Gregory Benjamin Carron, Hamilton (CA)

( * ) Notice: Subject to any disclaimer, the term of this patent is extended or adjusted under 35 U.S.C. 154(b) by 0 days.

(21) Appl. No.: 17/345,845

(22) Filed: Jun. 11, 2021

(65) Prior Publication Data

US 2021/0386214 A1 Dec. 16, 2021

Related U.S. Application Data

(60) Provisional application No. 63/038,891, filed on Jun. 14, 2020.

(51) Int. Cl.
*A47D 13/10* (2006.01)
*A47D 13/04* (2006.01)

(52) U.S. Cl.
CPC ..... *A47D 13/107* (2013.01); *A47D 13/046* (2013.01)

(58) Field of Classification Search
CPC .. A47D 13/107; A47D 13/086; A47D 13/046; A47D 13/08; A63B 2022/0092
USPC ..... 297/465, 467; 119/770
See application file for complete search history.

(56) References Cited

U.S. PATENT DOCUMENTS 2,413,395 A * 12/1946 Ware ..... A47D 15/006 473/576
2,812,123 A * 11/1957 Girton ..... A47D 13/086 224/150
3,447,832 A * 6/1969 Shaw ..... A47D 13/105 297/274
4,763,894 A 8/1988 Barrett
5,242,212 A 9/1993 Polley
5,388,551 A * 2/1995 Martusciello ..... A47D 13/046 119/770
6,651,594 B1 * 11/2003 Bagwell ..... A47D 13/086 119/770
6,932,709 B1 8/2005 Gubitosi et al.
8,070,617 B2 12/2011 Barron et al.
8,092,225 B1 * 1/2012 Ho ..... G09B 19/003 434/255
9,168,461 B1 10/2015 Chen
2006/0070798 A1 * 4/2006 DiCristina ..... A47D 13/046 182/3
2006/0180095 A1 * 8/2006 Burton ..... A01K 15/02 119/770
2007/0136931 A1 * 6/2007 Woodman ..... A47D 13/046 2/305

(Continued)

FOREIGN PATENT DOCUMENTS

CA 568775 A 1/1959
CA 679352 A 2/1964

(Continued)

*Primary Examiner* — Milton Nelson, Jr.

(57) ABSTRACT

A baby exerciser that facilitates parent-supported baby exercise by allowing the parent to maintain an upright posture throughout the baby exercise process. The baby exerciser has a baby seat harness with elements that support the crotch and torso of the baby in an upright position. The baby seat harness is suspended from thigh straps that attach to the thighs of a parent or adult. The baby exerciser is easily portable and can be used in private or public spaces to provide exercise and amusement to both adult and baby.

19 Claims, 7 Drawing Sheets

(56) References Cited

U.S. PATENT DOCUMENTS

2008/0018163 A1* 1/2008 Winn ..... A47D 13/046
297/465

FOREIGN PATENT DOCUMENTS

EP 0355223 A1 2/1990
FR 2635668 A1 * 3/1990 ..... A47D 13/107

* cited by examiner

BABY EXERCISER

CROSS-REFERENCE TO RELATED APPLICATIONS

This application claims priority to U.S. provisional patent application U.S. 63/038,891 filed on 14 Jun. 2020, which is hereby incorporated by reference herein in its entirety.

FIELD OF THE INVENTION

This invention relates to exercisers for babies where the exerciser and baby can be entirely supported by an adult. The present invention also relates to a travel baby exerciser which can be used by an adult to support a baby or toddler, for example, on planes, trains, buses, in public or private spaces, without an external support frame or support structure.

BACKGROUND

Baby exercisers provide support, stability, and limited mobility to infants as they move to ensure an upright, standing, default position. Exercisers of the prior art have typically comprised a baby harness that is suspended from a solid, external structural support. In some cases, this external support is a permanently mounted hook, doorjamb, other mountable device, or structural frame. The baby harness is flexibly connected to the structural support to allow for limited and controlled mobility. This flexible connection between the harness and external support can be conferred by, for example, dynamic metal, elastomeric springs or elastomeric connectors.

Exercise is critical for health and is especially important for babies as their bodies and brains are developing rapidly. This physical activity is needed to facilitate the growth, development and overall health of children in their early years of life. Babies depend on physical support to ensure their safety during upright exercise. The likelihood of collapse is heightened for babies that are newly engaged in standing or walking as the muscles required for these activities are still developing. A fall can cause severe damage to an infant and may discourage the baby from continuing to engage in upright activity.

Baby exercisers, of a type commonly marketed under the trademark JOLLY JUMPER® are known in the art, having first been described in Canadian Patent No. 568,775 granted in 1959 and Canadian Patent No. 679,352 granted in 1964, both of which are incorporated by reference herein in their entirety. In such exercisers, the child is seated in a harness which is suspended by means of a metal spring or an elastomeric spring from a permanently mounted hook or from a door jamb. Because of the fact that the upper end of the suspension device is located at a substantial height, it is possible to use a vertically extending spring of a substantial length as the suspension means. Because the spring has a substantial length, it is capable of providing a gentle extension and contraction, allowing the baby's feet to touch the floor, which in turn allows the baby to engage in bouncing, stepping, simulated walking/running, etc. These exercisers are not fully portable, in that they can only be employed where a suitable suspension hook or door jamb is available. A later patent, namely Canadian Patent No. 955,177 granted in 1974, incorporated by reference herein in its entirety, describes a more portable version of the original JOLLY JUMPER®, whereby a portable frame is used to suspend the harness, therefore allowing deployment of the exerciser in places where a ceiling hook or a door jamb are not available. However, baby exercisers of this type require a frame of significant size to be stable, making them cumbersome and unsuitable for travel.

Various other baby exerciser devices are known that are either mounted to the ground, suspended from a frame or mountable device, or suspended from a hook or ceiling. In an example, United States patent U.S. Pat. No. 9,168,461 to Chen describes a bouncer swing that has a suspension frame having legs, elastic connectors connected to the suspension frame, a seat harness, and a trampoline bed. This baby exerciser allows small children to bounce safely on the trampoline while being held in the harness.

External structural support systems limit the portability of baby exercisers by restricting their utility to circumstances where the support system can be employed. These structural supports may be permanently anchored to a wall, floor or ceiling or they might be elaborate frames or mountable devices. There is an unmet need in the market for a baby exerciser that is portable, compact, and that can be deployed even in very tight spaces, and still allow parents to give their babies much needed movement, fun and exercise instead of confining babies to carriers or allowing them to crawl on unclean floors. While many suspended swings and jumping devices have been described in the prior art for use with infants and young children, there remains a need for a device that can support a child in the absence of a structural support.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

It is an object of present invention to provide an adult-supported baby exerciser that does not require an external structural support.

In an aspect of the present invention is provided a baby exerciser comprising: a baby seat harness comprising a front portion, a crotch portion, and a back portion; and two adult thigh straps; and two suspension straps, each suspension strap connecting one of the two adult thigh straps to a top of the front portion or back portion of the baby seat harness.

In an embodiment the suspension straps are dynamic.

In another embodiment each of the suspension straps is bifurcated and attached to the front portion and the back portion of the baby seat harness.

In another embodiment when the thigh loops are worn by an adult and a baby is sitting in the seat harness the suspension straps are extended such that the baby's feet contact the floor.

In another embodiment the baby exerciser further comprises a stabilizer belt and at least two garters, each of the garters connecting one of the thigh loops.

In another embodiment the garters are static straps.

In another embodiment the garters are adjustable in length.

In another embodiment the garters are releasably secured to the thigh straps.

In another embodiment the stabilizer belt is comprised of elastomeric material.

In another embodiment the stabilizer belt is adjustable in diameter.

In another embodiment the suspension straps are linked by releasable connectors to the thigh straps.

In another embodiment the suspension straps are releasably connected to the seat harness.

In another embodiment the suspension straps are adjustable in length.

In another embodiment the thigh loops are adjustable in circumference.

In another embodiment the seat harness circumference around the back portion and front portion is adjustable.

In another embodiment the seat harness further comprises at least one fabric extension and extension fastener to lengthen the front portion or the back portion.

In another embodiment the crotch portion of the seat harness comprises at least one cushion, soft support, and hard support.

In another aspect there is provided a baby exerciser comprising: a baby seat harness comprising a front portion, a crotch portion, and a back portion; and two adult thigh straps; a stabilizer belt having at least two garters, each of the garters connecting to one of the thigh loops; and two suspension straps, each suspension strap connecting one of the two adult thigh straps to a top of the front portion or back portion of the baby seat harness.

In an embodiment, the garters are static straps.

Embodiments of the present invention as recited herein may be combined in any combination or permutation.

BRIEF DESCRIPTION OF THE FIGURES

The features which are believed to be characteristic of the present invention, as to its structure, functionality, use and method of operation, together with further objectives, other aspects, and further features thereof and advantages thereof, will be better understood from the following drawings in which preferred embodiments of the invention are illustrated by way of example. It is expressly understood, however, that the following drawings are for the purpose of illustration and description only and are not intended as a definition of the limits of the invention. Reference is made to the following description which is to be used in conjunction with the accompanying drawings, where.

DETAILED DESCRIPTION OF THE INVENTION

Figure 1:
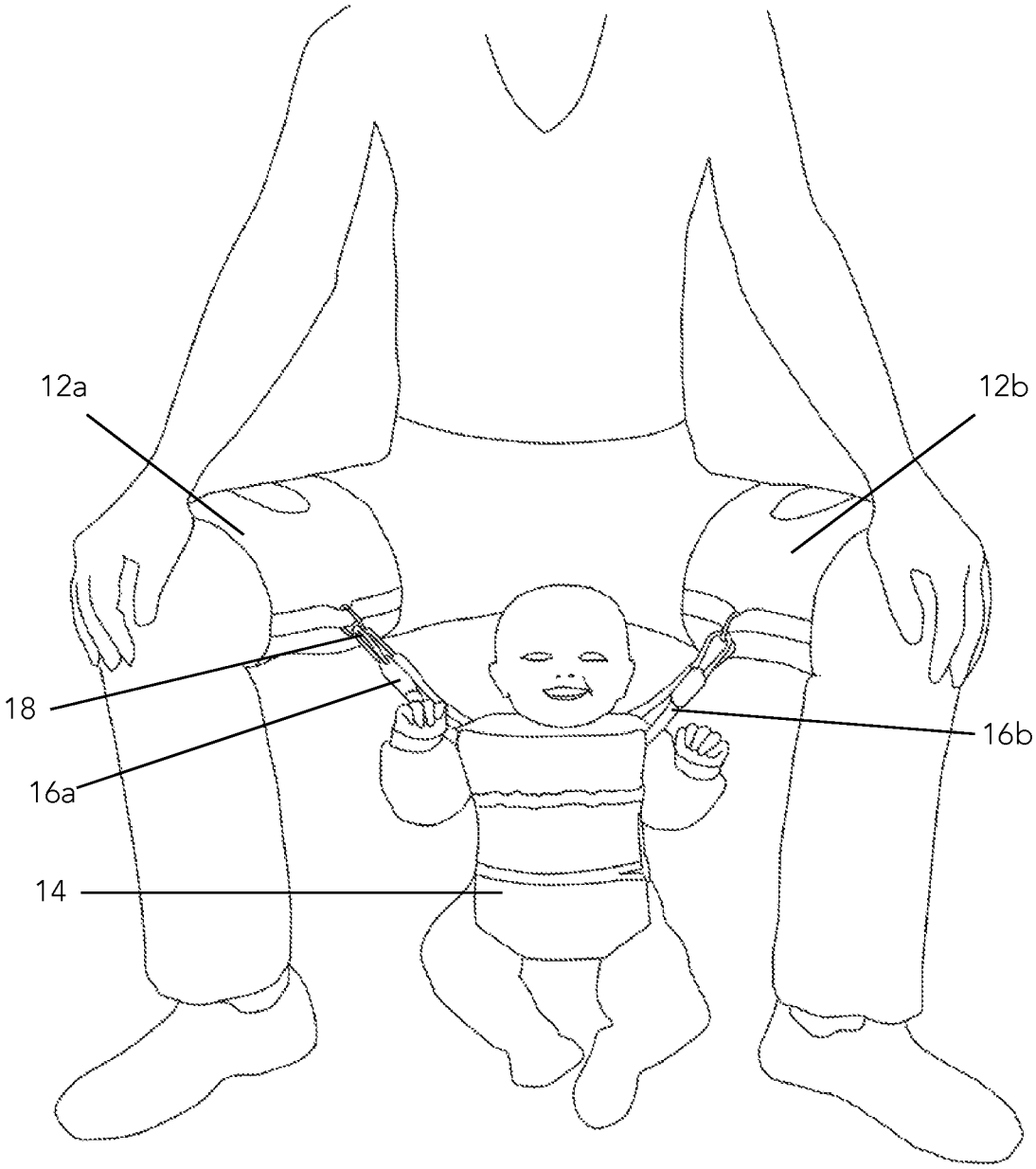
FIG. 1 is a front view of a baby exerciser worn by an adult in a seated position with a baby in the exerciser.

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise.

The term "comprise" and any of its derivatives (e.g. comprises, comprising) as used in this specification is to be taken to be inclusive of features to which it refers, and is not meant to exclude the presence of any additional features unless otherwise stated or implied. The term "comprising" as used herein will also be understood to mean that the list following is non-exhaustive and may or may not include any other additional suitable items, for example one or more further feature(s), component(s) and/or element(s) as appropriate.

As used herein, the terms "comprising," "having," "including" and "containing," and grammatical variations thereof, are inclusive or open-ended and do not exclude additional, unrecited elements and/or method steps. The term "consisting essentially of" when used herein in connection with a composition, device, article, system, use, or method, denotes that additional elements and/or method steps may be present, but that these additions do not materially affect the manner in which the recited composition, device, article, system, method, or use functions. The term "consisting of" when used herein in connection with a composition, device, article, system, use, or method, excludes the presence of additional elements and/or method steps. A composition, device, article, system, use, or method described herein as comprising certain elements and/or steps may also, in certain embodiments consist essentially of those elements and/or steps, and in other embodiments consist of those elements and/or steps, whether or not these embodiments are specifically referred to.

As used herein, the term "about" refers to an approximately +/−10% variation from a given value. It is to be understood that such a variation is always included in any given value provided herein, whether or not it is specifically referred to. The recitation of ranges herein is intended to convey both the ranges and individual values falling within the ranges, to the same place value as the numerals used to denote the range, unless otherwise indicated herein.

The use of any examples or exemplary language, e.g. "such as", "exemplary embodiment", "illustrative embodiment" and "for example" is intended to illustrate or denote aspects, embodiments, variations, elements or features relating to the invention and not intended to limit the scope of the invention.

As used herein, the terms "connect" and "connected" refer to any direct or indirect physical association between elements or features of the present disclosure. Accordingly, these terms may be understood to denote elements or features that are partly or completely contained within one another, attached, coupled, disposed on, joined together, in communication with, operatively associated with, etc., even if there are other elements or features intervening between the elements or features described as being connected.

Herein is described a portable baby exerciser that can be worn by an adult to support and suspend a baby or small child in an upright position. The present baby exerciser provides a harness adapted to seat a child, whereby the harness is suspended by two or more suspension cords which are attached to the parent's upper legs, preferably by straps which wrap around each leg, preferably at a point above the knee. The baby exerciser does not rely on external supports, entirely supports a baby by straps worn by an adult around their thighs, and is optionally additionally supported with a stabilizer belt. In using the thighs of a parent as a scaffold or support structure upon which to suspend the baby harness, the present invention circumvents the need for structural supports and renders a baby exerciser that is both easily portable and usable in small spaces and public spaces.

The present baby exerciser also facilitates parent-supported baby exercise by allowing the parent to maintain an upright posture throughout the baby exercise process. It is noted that baby exercisers of the prior art inadvertently separate parent from child, as these devices are self-contained, externally supported, and do not depend on continual parental supervision. Although this may be a feature in some instances, such as when a parent requires free hands, it can equally deprive parents of an opportunity to participate intimately in their baby's exercise. Physical proximity between the parent and child during exercise can increase the joy and comfort of the baby, while reducing the possibility of injury. In addition, proximity between child and parent can be comforting for both, and the present baby exerciser can provide another method for bonding between babies and adults.

While a baby or small child is engaging in provisional or early walking, parents often rely on their extended hands to stabilize an infant that is engaged in upright activity. However, extending their arms downward to reach a child forces the parent to assume a hunched position, wherein their back is bent over in order to provide the necessary support. Sustained activity of this kind brings an increased risk of back injury to the parent, including muscle strain. In use of the present baby exerciser, a child can be supported in an upright position for play, exercise, or the beginning stages of walking without requiring an adult to use their hands or bend over to hold the baby. This prevents back pain, strain, or other injuries that may arise in an adult frequently engaged in such activity. Similarly, repeated kneeling by the parent can give rise to bursitis or inflammation of the knee, which can also be prevented by the present baby exerciser by supporting the baby using the legs of the adult. The present invention is also easily portable as it does not rely on external structural support systems.

FIG. 1 is a front view of the baby exerciser worn by an adult in a seated position with a baby in the exerciser. The baby exerciser is attached to the upper legs of an adult at each thigh by two thigh straps 12*a*, 12*b*, and the child is seated in a seat harness 14 between the adult's legs with the seat harness 14 suspended from the thigh straps 12*a*, 12*b* by suspension straps 16*a*, 16*b*. The suspension straps 16*a*, 16*b* on each side of the seat harness 14 connect to the thigh straps 12*a*, 12*b* on the adult portion of the baby exerciser to support the baby in an upright position when the baby is seated in the seat harness 14. Each suspension strap 16*a*, 16*b*, as shown in this embodiment, is secured to thigh straps 12*a*, 12*b* with a connector 18, which can comprise a ring, loop, or a detachable connector such as clip, clasp, buckle, carabiner, or spring mechanism. The connector 18 can also have a quick and reversible connection to the seat harness 14 and/or thigh strap 12, such as, for example, with a D-ring affixed to each strap, a quick release clasp, or other releasable connector mechanism. When the suspension straps 16*a*, 16*b* have releasable connectors 18 to releasably attach to the thigh straps 12*a*, 12*b*, the thigh straps 12*a*, 12*b* may be more easily put onto and adjusted by the adult, and the adult can walk or move while wearing the thigh straps without being hindered by dangling suspension straps 16*a*, 16*b*. Alternatively, the suspension straps 16*a*, 16*b* can be permanently affixed in a non-adjustable way to each of the thigh straps 12*a*, 12*b* and to the top of the baby seat harness 14. The suspension straps 16*a*, 16*b* are attached to the baby seat harness 14 near where the baby's shoulders align when a baby is sitting in the harness, either on the top of the front portion or the top of the bottom portion, or both. In a preferred embodiment the baby seat harness 14 is suspended on each side, proximal to where the baby's shoulders are when a baby is seated in the seat harness, by two double suspension cords or suspension straps 16*a*, 16*b*, which attach to both the front portion and back portion of the seat harness. This provides additional stability and prevents the baby from tilting forward or backward when in the harness.

The suspension straps 16*a*, 16*b* are preferably dynamic and stretch to provide a bounce or jump experience for the child seated in the seat harness 14. Dynamic, as referred to herein, means that the component is elastic or stretchable with pulling force, and returns to its original shape when the pulling force is removed. Preferably, the baby exerciser is also adjustable such that when the baby's feet touch the floor there is tension on the suspension straps 16*a*, 16*b* to enable bouncing or jumping. It is noted that when the child's feet are touching the floor the child is free to bounce, practice walking, run, and move around while the parent's hands are free. The two double suspension straps 16*a*, 16*b* shown attached to the seat harness 14 can be of any type known in the art, including elastic (dynamic) materials, rigid (static) materials or any other material of suitable strength to hold the weight of a baby. The suspension straps 16*a*, 16*b* are preferably dynamic straps that have some stretch or give, to enable the baby to jump or bounce in the seat harness 14. In a preferred embodiment, the suspension straps 16*a*, 16*b* are separated into two or bifurcated at the point of attachment to the baby seat harness 14, such that each suspension strap 16*a*, 16*b* attaches to the seat harness 14 at the front and back of the seat harness 14, or at the front of the shoulder and back of the shoulder of the child. This bifurcation provides additional support to the child. The suspension straps 16*a*, 16*b* can also be attached to the thigh straps 12*a*, 12*b* by any known means of attachment, such as, for example, using direct attachment by sewing, adhesive, loop, or combination thereof.

The thigh straps 12*a*, 12*b* are attached to the parent's upper legs, preferably by removable straps which wrap around each leg, preferably secured to the thigh at a point above the parent's knee. The suspension straps 16*a*, 16*b* attached to an adult, in conjunction with the crotch and torso support afforded by the baby seat harness 14, provide an upright default position that the supportive hands of a parent would otherwise be relied upon to achieve, allowing a parent to be fully engaged in the exercise of their baby without putting excessive strain on their bodies. Suspending the child in the supported seat harness 14 at a position higher than the centre of mass of the child, such as at the shoulders of the child, also ensures that the child is well supported in an upright position.

The seat harness in which the child is seated can be of any type known in the art of making such child harnesses. Preferably the seat harness does not have a spreader bar as this can potentially get in the way of movement of the adult wearing the baby exerciser. In particular, there is no need for a spreader bar because the parent can impart the spreading action with his/her knees while in a standing or seated position. Furthermore, by either spreading the knees further apart or bringing the knees closer together, the parent or adult wearing the baby exerciser can effect a significant degree of vertical adjustment to the height at which the baby is suspended. For these reasons, the present invention allows for varied child movements and for more "play value" and "exercise value" for both adult and baby. The front of the seat harness can also comprise one or more hoops, loops, clips, hook-and-loop connectors, or points of attachment to allow for toys to be hung or attached. Toys and soothers, or essentially any item that the baby can grab and play with, can be attached thereto, along with lights or other objects for stimulating the baby. In addition, the front of the seat harness can be adapted to receive one or more electronic toys, music or noise making toys, lights, or other electronic devices. Customizable concepts can also be offered to as a specialized or branded notation, such as, for example, sports team or brand logo optionally with other built-in components.

Idea is to be able to attach soothers or essentially any item that they can grab and play with, along with lights or other things for the babies stimulus The presently described baby exerciser can be packed compactly and can be deployed easily and quickly even in the tightest spaces, such as during travel on planes, trains, buses, in waiting rooms, in airports, in public spaces, outdoors on the beach, at a park bench, and anywhere where a parent can find a seat to sit on or a place to walk or stand. When seated in the baby exerciser a child is secured between the parent's legs, and always within the reach and eyesight of the parent. This allows the parent or adult to consistently supervise their baby during upright exercise. In addition, supporting the child between the legs of the adult enables the parent or adult to retain their hands free to do other useful or desired activities, such as read, eat, use handheld devices, etc.

The baby seat harness may be worn such that the baby faces in either the same or opposite direction as the adult. For example, the baby can face in the same direction as the adult to see and explore whatever is in front. Alternatively, the child may be seated in the harness facing the parent or adult so that meaningful visual contact and interaction can take place between the parent or adult and child. If there are two parents or adults present, the baby exerciser according to this invention can be easily transferred from one parent to another, with the child remaining in the harness during transfer, simply by undoing the thigh straps from one parent's legs and attaching them to the legs of the other parent or adult. The baby exerciser can is also be waterproof and act as a way to help children learn to float or kick in water, providing an additional way to exercise. The baby exerciser can also include buoyant materials and have a buoyant and waterproof design such that the baby can float in water.

Figure 2A:
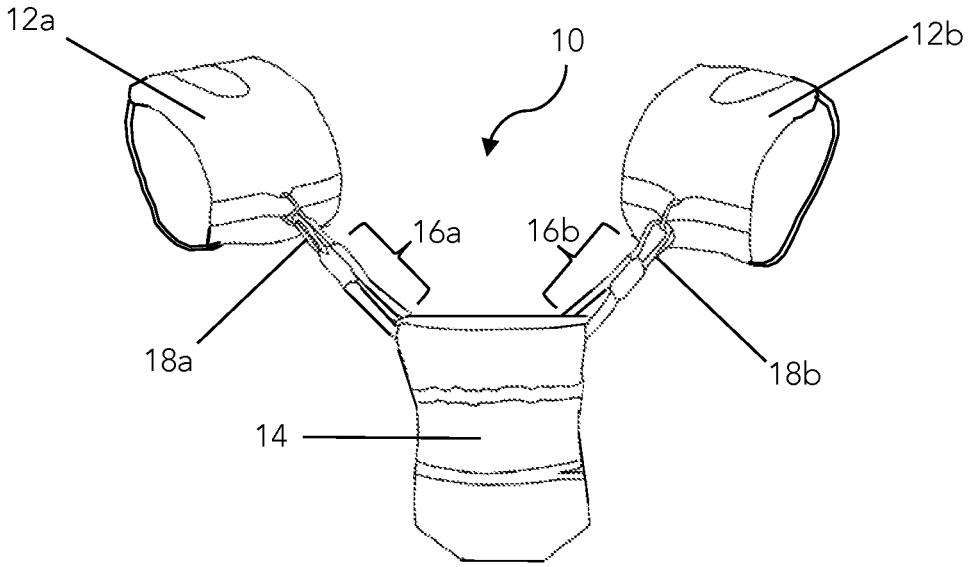
FIG. 2A is a front view of a baby exerciser.

FIG. 2A is a front view of a baby exerciser 10. Thigh straps 12*a*, 12*b* are loops that can be securely attached to the thighs of an adult above the knee and are preferably adjustable to accommodate a wide range of adult thigh circumferences. The material of the thigh straps 12*a*, 12*b* can be static (non-stretchy) dynamic (stretchy) or a combination thereof. Preferably, the loops formed by thigh straps 12*a*, 12*b* can be reversibly opened to enable the adult to more easily put on each thigh strap. The thigh straps 12*a*, 12*b* can further have one or more circumference adjustment closure or attachment mechanism such as a hook and loop closure, clip, clasp, buckle, snap, belt, or other attachment means to comfortably adjust and secure the circumference of the closed thigh strap 12*a*, 12*b* around a person's thigh. Optional thigh strap extenders or different sizes of thigh strap can also be available to extend the circumference of the thigh straps for different sizes. Suspension straps 16*a*, 16*b* connected to the baby seat harness 14 are shown with carabiner-type connectors 18*a*, 18*b* which connect to attachment loops on the thigh straps 12*a*, 12*b*.

Figure 2B:
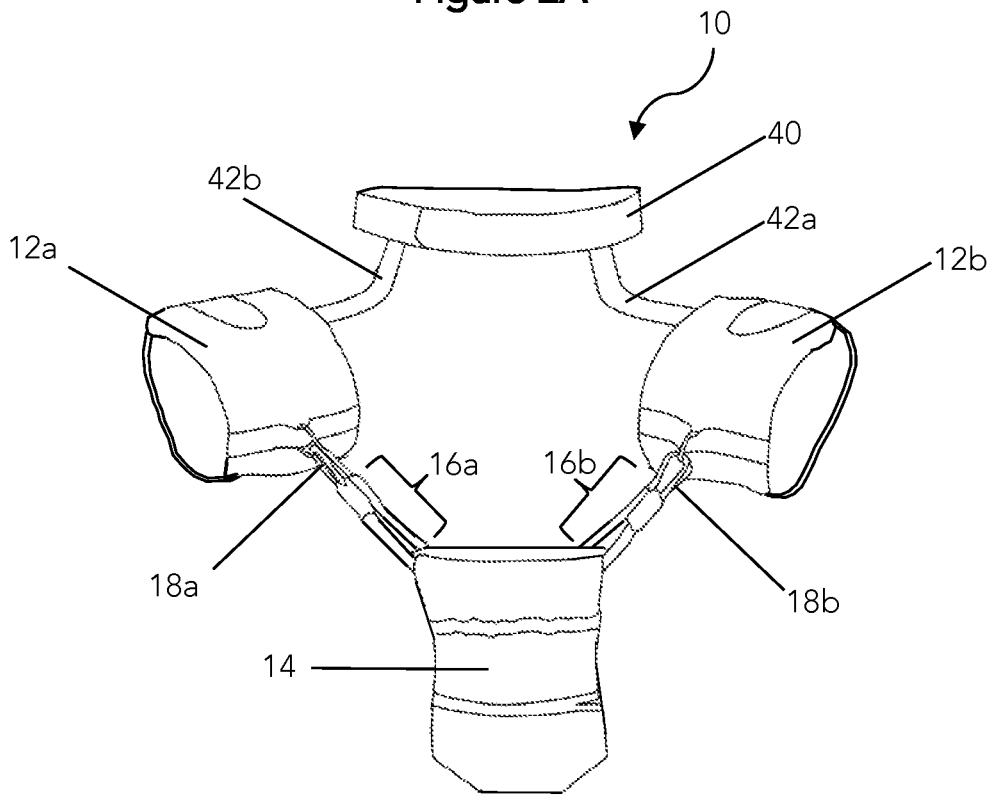
FIG. 2B is a front view of a baby exerciser with a stabilizer belt.

FIG. 2B is a front view of a baby exerciser 10 with a stabilizer belt 40. The stabilizer belt 40 is connected to each of the thigh straps 12*a*, 12*b* by one or more garters 42*a*, 42*b*, which are preferably static straps attaching the front and back of each thigh strap to the front and back of the stabilizer belt 40. Garters 42*a*, 42*b* are also preferably adjustable in length such that the distance between the stabilizer belt 40 and thigh straps 12*a*, 12*b* can be adjusted to accommodate the size and shape of the adult wearing the baby exerciser 10. Suspension straps 16*a*, 16*b* are connected to the thigh straps 12*a*, 12*b* and support the baby harness 14. The volume of the cavity formed by the baby harness 14 to receive the baby is clearly visible and can also preferably be adjusted to accommodate babies and small children as they grow.

Figure 3:
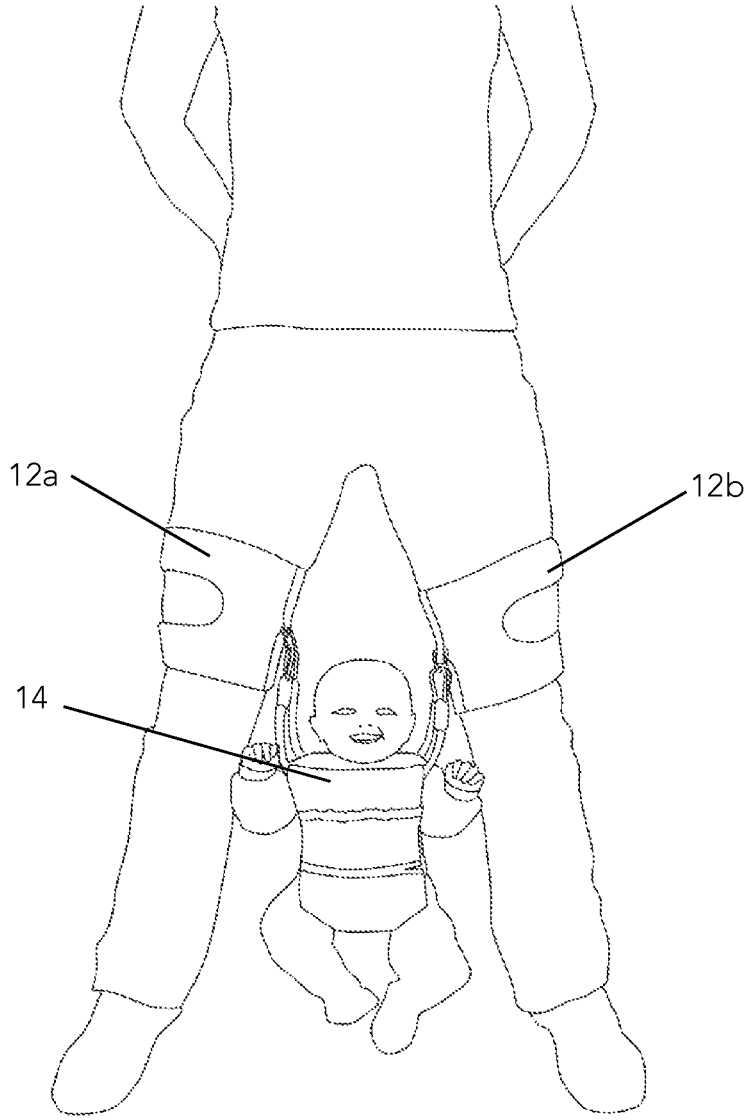
FIG. 3 is a front view of a baby exerciser worn by an adult in a standing position with a baby in the exerciser.

FIG. 3 is a front view of the baby exerciser 10 worn by an adult in a standing position with a baby in the exerciser. The thigh straps 12*a*, 12*b* are attached to the upper legs of a standing adult and the baby harness 14 is suspended by dynamic straps from the thighs of the parent. The present baby exerciser facilitates parent-supported baby exercise by allowing the parent to maintain an upright posture throughout the baby exercise process. The baby exerciser can thereby preserve the physical wellbeing of the adult by eliminating the need to bend over or kneel when stabilizing a baby during upright exercise. When the adult wearing the present baby exerciser is in a standing or walking position, the adult can walk with the baby as the baby is learning to engage in upright activity. In the position shown where the adult is standing, the baby and adult can also move, step, sway, or walk, to create a genuine upright walking-type experience. In moving with a baby, a parent provides their baby with a genuine walking experience with forward locomotion and is able to support the baby during walking. This configuration also allows a parent to easily intervene and participate in the upright exercise of their baby when desired, without needing to maintain a bent-over or kneeling position. In addition, by supporting the baby in an upright position during the walking experience, the presently described baby exerciser may increase a baby's confidence in walking. In doing so, use of the baby exerciser described herein may accelerate the rate at which a baby learns to walk and run.

Figure 4:
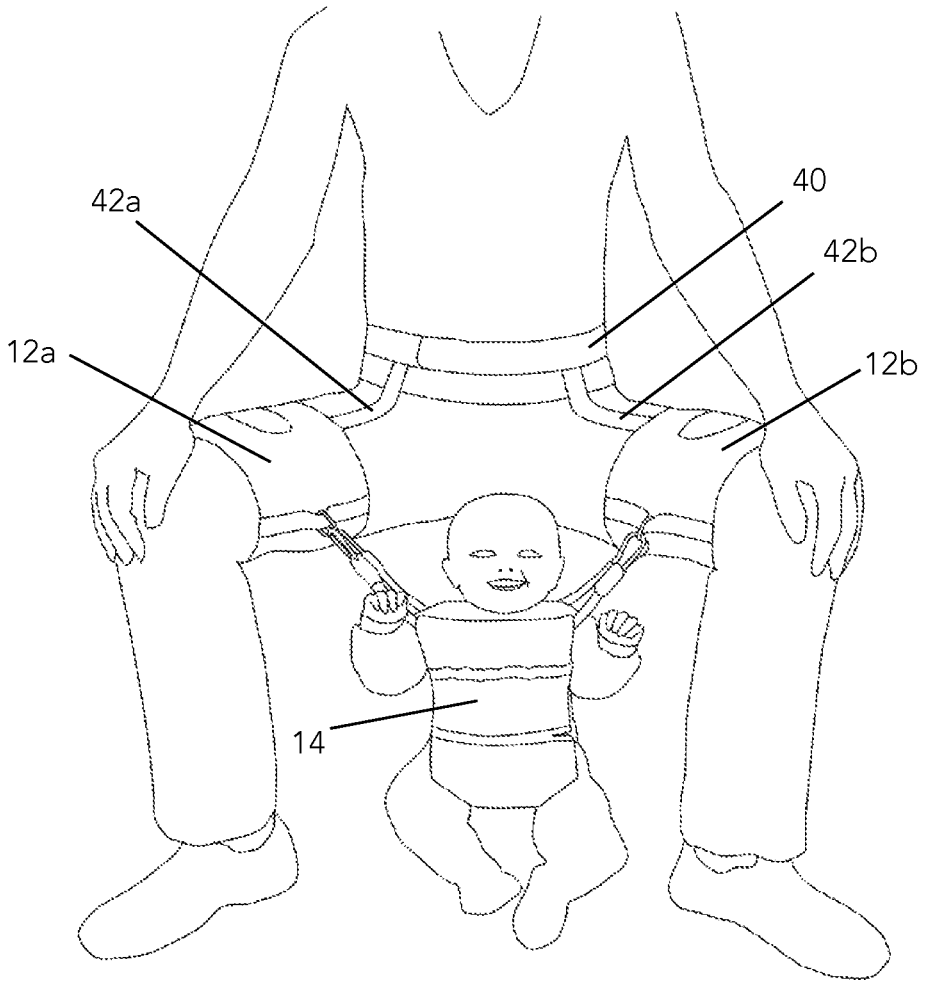
FIG. 4 is a front view of a baby exerciser with a stabilizer belt worn by an adult in a seated position.

FIG. 4 is a front view of the baby exerciser worn by an adult in a seated position with a stabilizer belt 40 is secured around the waist of the adult. The baby exerciser shown has a stabilizer belt 40 that attaches to thigh loops 12*a*, 12*b* by garters 42*a*, 42*b*, and the thigh loops 12*a*, 12*b* are attached to seat harness 14, stabilizing a baby in an upright position. The seat harness 14 can also comprise additional cushioning, soft supports, and/or hard supports (such as one or more rib) to provide additional structure to the harness and comfort to the baby.

Figure 5:
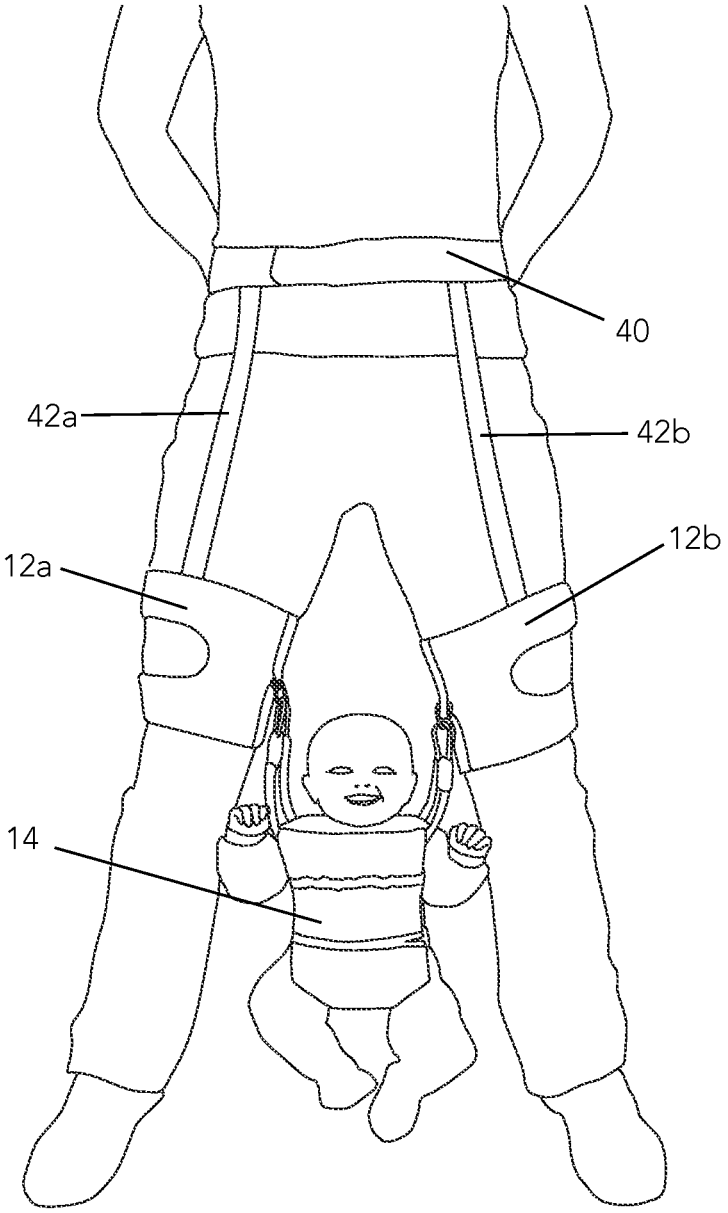
FIG. 5 is a front view of a baby exerciser with a stabilizer belt worn by an adult in a standing position.

FIG. 5 is a front view of the baby exerciser 10 worn by an adult in a standing position, wherein the adult is also wearing a stabilizer belt 40 that is connected to thigh loops 12*a*, 12*b* by static adjustable garters 42*a*, 42*b*. The baby is securely seated in baby seat harness 14 which is attached to thigh loops 12*a*, 12*b*. Optional adjustable garters 42*a*, 42*b* can be adjusted in length to provide additional support to secure thigh loops 12*a*, 12*b* at the desired height on the adult's legs and prevent slipping of the thigh loops 12*a*, 12*b*. The length of the garters 42*a*, 42*b* can also be adjusted to accommodate the child size, adult height and size, and comfort of the adult wearing the baby exerciser.

Figure 6A:
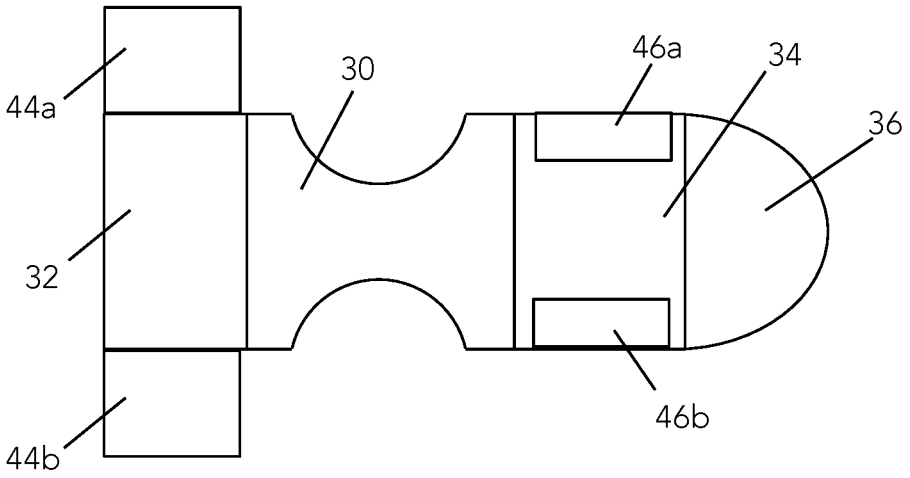
FIG. 6A is a flat pattern illustration of a baby seat harness.

FIG. 6A is a flat pattern illustration of a baby seat harness. The seat harness has, connected in series, a front section 32, a crotch section 30, and a back section 34. The front section 32 attaches to the back section 34 via fastener tabs 44*a*, 44*b* which connect to the attachment tabs 46*a*, 46*b* on the front section 32. The fastener tabs 44*a*, 44*b* and attachment tabs 46*a*, 46*b* can have one or more snaps, hook and loop closures (e.g. Velcro®, snaps, buckles, zippers, or other attachment mechanism, or combination thereof. Alternatively, the front section and back section can be attached together with a zipper, optionally attached to one or more tabs extending from the front section or back section. The fastener tabs can also be on the back section and the attachment tabs can be on the front section. In an alternative configuration the front section can be releasably or permanently attached to the back section by sewing, for example. The seam or attachment point between the front section 32 and the back section 34 can also have one or more fabrics that can be released with a zipper to enlarge the seat harness to accommodate a larger child. The material of the seat harness components, including the front and back section, crotch, and fastener tabs, can be static or not-stretchy, dynamic or stretchy, or a combination thereof. The back section 34 can also optionally comprise a head support 36 which is useful to support the head of a younger child or child whose neck would benefit from additional support. It is understood, of course, that the baby exerciser should be used only with children old enough to safely support their body and head in an upright position.

Figure 6B:
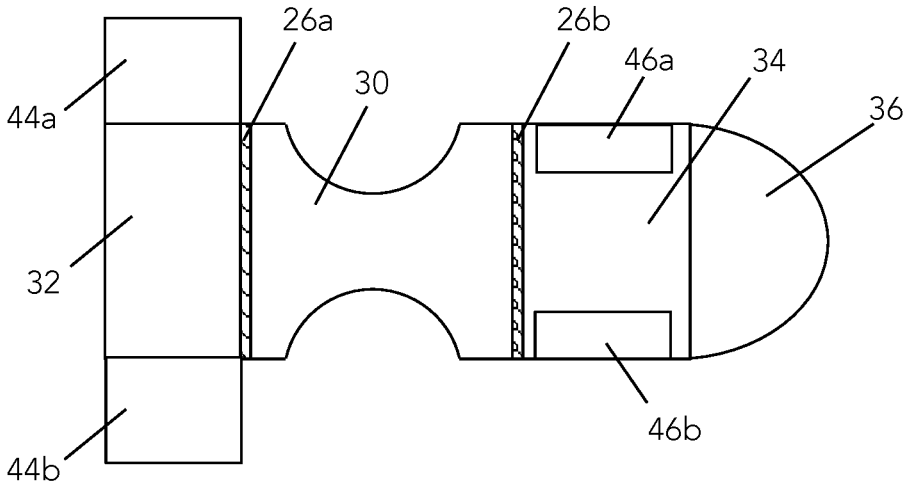
FIG. 6B is a flat pattern illustration of an extendable baby seat harness in a compact configuration.

FIG. 6B is a flat pattern illustration of an extendable baby harness in a compact configuration. As described, the seat harness has, connected in series, a front section 32, a crotch section 30, and a back section 34. The front section 32 attaches to the back section 34 via fastener tabs 44*a*, 44*b* which connect to the attachment tabs 46*a*, 46*b* on the front section 32. In an embodiment where the seat harness is extendable, one or more extension fasteners 26*a*, 26*b* can be connected to enable the release of fabric to extend the length of the front section 32 and/or back section 34. The extension fasteners 26*a*, 26*b* allow the fabric of the seat harness to be extended to accommodate a larger child or contracted to accommodate a smaller child. The extension fasteners 26*a*, 26*b* can have one or more snaps, hook and loop closures (e.g. Velcro®, snaps, buckles, zippers, or other attachment mechanism, or combination thereof.

Figure 6C:
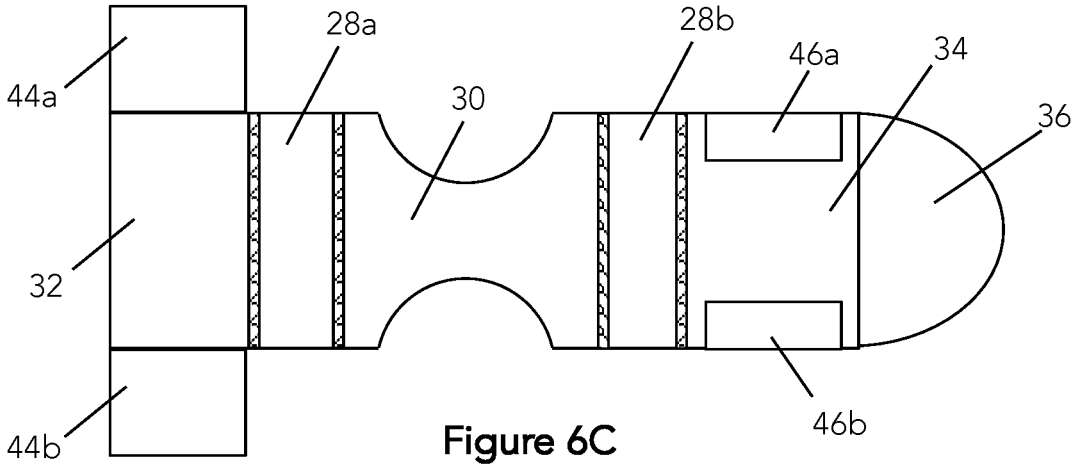
FIG. 6C is a flat pattern illustration of an extendable baby seat harness in an extended configuration.

FIG. 6C is a flat pattern illustration of an extendable baby harness in an extended configuration. As described, the seat harness has, connected in series, a front section 32, a crotch section 30, and a back section 34. The front section 32 attaches to the back section 34 via fastener tabs 44*a*, 44*b* which connect to the attachment tabs 46*a*, 46*b* on the front section 32. In this configuration, extension fasteners 26*a*, 26*b* are open to extend fabric extensions 28*a*, 28*b* in an extended or released position to accommodate a larger child.

Figure 7:
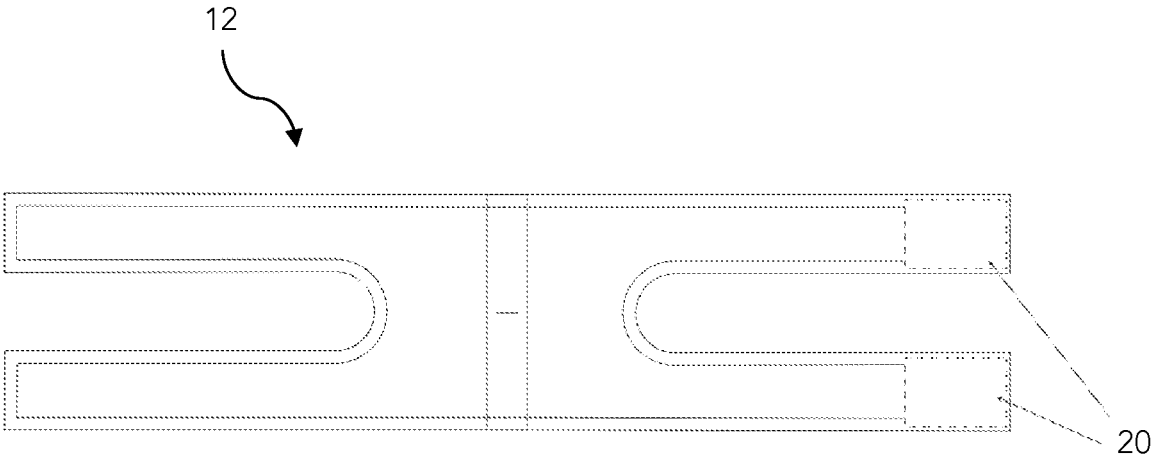
FIG. 7 is a flat pattern illustration of a single thigh strap.

FIG. 7 is a flat pattern illustration of a single thigh strap 12. The removable thigh strap 12 attaches to the parent or adult's legs and is preferably made of a suitable durable webbing-type of strap material, fastened with a thigh strap fastener 20, which is preferably a hook and loop (e.g. VELCRO®) closure. Any other known strapping materials can be used, including durable fabrics and combinations of fabrics, to support secure but comfortable attachment to the thighs of an adult. Any known means of releasable fastening to a user's legs or knees can be used, including one or more clasps, hook and loop fasteners, hooks, buttons, clips, hook and eye fasteners (i.e. belt-type fasteners), zippers. The thigh straps can also have one or more releasable fastening devices. The thigh straps may be made from a non-stretchable fabric, have sections, or be entirely made from a stretchable material or fabric to provide more comfort to the wearer, or have a combination of fabrics. Optional additional thigh strap extenders can also be provided to accommodate larger adults, either as extendable section on the thigh straps or additional pieces that can be added or attached. The baby exerciser can further comprise garters, shackles, or belts that can be used on parent's legs in addition to or instead of straps.

Other alternative embodiments of this invention may work without any external straps attached to the user's legs; such embodiments may suspend the suspension straps from rings or loops of fabric/metal/plastic that come pre-attached to the parent's pants or shorts or sleeves or wrist-straps, or any other items of clothing, at a height suitable for suspending the baby exerciser according to this invention. Other alternative embodiments may lack the separate straps and may come simply with extra-long suspension straps which can be wrapped or tied around the user's thighs or knees.

Other alternative embodiments of the described baby exerciser may have more than two double suspension straps, or fewer than two double suspension straps, may have a spreader bar to maintain a desired distance between the suspension straps, or may be adapted to attach the suspension straps from another object or objects suitable as hanging points, such as the arms of an armchair, or the folding table on the back of an airplane seat. In other alternative embodiments the suspension straps may even be held by the parents in their own hands, optionally with a spreader bar, to allow even more degrees of mobility and adjustment to the baby exerciser.

The baby exerciser can be sold as a full travel-kit containing the baby seat harness, the suspension straps and the thigh straps. Alternative embodiments of the baby exerciser may include only the suspension straps and/or the leg straps, with instructions to use, transfer, or adapt the seat-harness from pre-existing stationary types of baby seat harnesses. Alternative embodiments of this invention may also have the "travel" components of the baby exerciser such as the suspension straps and/or the thigh straps as an add-on kit to complement a non-travel type of the baby exerciser, with various parts shared between the travel and the stationary or structural versions of other stationary baby exercisers having external structures, such as parallel bars, supported hooks, or a frame with legs, or components that attach to structural components such as an upper member of a door frame jamb or stationary attachment points.

All publications, patents and patent applications mentioned in this specification are indicative of the level of skill of those skilled in the art to which this invention pertains and are herein incorporated by reference. The reference to any prior art in this specification is not, and should not be taken as, an acknowledgement or any form of suggestion that such prior art forms part of the common general knowledge.

The invention being thus described, it will be obvious that the same may be varied in many ways. Such variations are not to be regarded as a departure from the scope of the invention, and all such modifications as would be obvious to one skilled in the art are intended to be included within the scope of the following claims.

I claim:

1. A baby exerciser comprising:

a baby seat harness comprising a front portion, a crotch portion, and a back portion;

two adult thigh straps, each thigh strap comprising a thigh strap attachment loop and reversibly openable to a flat configuration such that each thigh strap can be securely attached with a fastener around the thigh of an adult above the knee; and four suspension straps, each suspension strap comprising a first end attached to a connector to connect the suspension strap to one of the two adult thigh straps through the thigh strap attachment loop and a second end extending from the top of the front portion or the top of the back portion of the baby seat harness to suspend the baby seat harness between the thigh straps.

2. The baby exerciser of claim 1, wherein the suspension straps are dynamic.

3. The baby exerciser of claim 1, wherein each thigh strap attachment loop is connected to two of the suspension straps through a single connector.

4. The baby exerciser of claim 1, wherein when the thigh straps are worn by an adult and a baby is sitting in the seat harness the suspension straps are extended such that the baby's feet contact the floor.

5. The baby exerciser of claim 1, further comprising a stabilizer belt and at least two garters, each of the garters connected to one of the thigh straps.

6. The baby exerciser of claim 5, wherein the garters are static straps.

7. The baby exerciser of claim 5, wherein the garters are adjustable in length.

8. The baby exerciser of claim 5, wherein the garters are releasably secured to the thigh straps.

9. The baby exerciser of claim 5, wherein the stabilizer belt is comprised of elastomeric material.

10. The baby exerciser of claim 5, wherein the stabilizer belt is adjustable in diameter.

11. The baby exerciser of claim 1, wherein the end of each of the suspension straps is permanently affixed to the top of the front portion or the top of the back portion of the baby seat harness.

12. The baby exerciser of claim 1, wherein the baby seat harness comprises one or more points of attachment to allow for toys to be hung or attached.

13. The baby exerciser of claim 1, wherein the suspension straps are adjustable in length.

14. The baby exerciser of claim 1, wherein the thigh straps are adjustable in circumference.

15. The baby exerciser of claim 1, wherein the seat harness circumference around the back portion and front portion is adjustable.

16. The baby exerciser of claim 1, wherein the seat harness further comprises at least one fabric extension and extension fastener to lengthen the front portion or the back portion.

17. The baby exerciser of claim 1, wherein the thigh straps are adjustable using a hook and loop closure.

18. A baby exerciser comprising:

a baby seat harness comprising a front portion, a crotch portion, and a back portion; and two adult thigh straps;

a stabilizer belt having at least two garters, each of the garters connecting to one of the thigh loops; and two suspension straps, each suspension strap connecting one of the two adult thigh straps to a top of the front portion or back portion of the baby seat harness.

19. The baby exerciser of claim 18, wherein the garters are static straps.

* * * * *